US007296995B2

(12) United States Patent
Niklaus et al.

(10) Patent No.: US 7,296,995 B2
(45) Date of Patent: Nov. 20, 2007

(54) CIRCULATING AIR OVEN

(75) Inventors: Michael Niklaus, Seuzach (CH); Christian Haas, Kreuzlingen (CH)

(73) Assignee: Strahm Textile Systems AG, Lengwil (CH)

( * ) Notice: Subject to any disclaimer, the term of this patent is extended or adjusted under 35 U.S.C. 154(b) by 0 days.

(21) Appl. No.: 10/562,657

(22) PCT Filed: Jun. 28, 2004

(86) PCT No.: PCT/CH2004/000402

§ 371 (c)(1),
(2), (4) Date: Feb. 2, 2006

(87) PCT Pub. No.: WO2005/003661

PCT Pub. Date: Jan. 13, 2005

(65) Prior Publication Data

US 2006/0150438 A1 Jul. 13, 2006

(30) Foreign Application Priority Data

Jul. 1, 2003 (CH) ..... 1160/03

(51) Int. Cl.
*F27B 9/28* (2006.01)

(52) U.S. Cl. ..... 432/59; 126/21 A

(58) Field of Classification Search ..... 432/8, 432/59, 121, 230, 239; 126/21 A
See application file for complete search history.

(56) References Cited

U.S. PATENT DOCUMENTS

| | | | | |
|---|---|---|---|---|
| 3,979,038 | A * | 9/1976 | Karlsson | 242/615.11 |
| 4,397,103 | A | 8/1983 | Rueff | |
| 4,462,383 | A * | 7/1984 | Henke et al. | 126/21 A |
| 4,753,215 | A * | 6/1988 | Kaminski et al. | 126/21 A |
| 5,423,248 | A * | 6/1995 | Smith et al. | 99/443 C |
| 5,915,304 | A * | 6/1999 | Stiel | 101/416.1 |
| 5,967,770 | A * | 10/1999 | Heine et al. | 432/59 |
| 6,073,368 | A | 6/2000 | Freiberg | |
| 6,592,364 | B2 * | 7/2003 | Zapata et al. | 432/145 |
| 6,776,611 | B1 * | 8/2004 | Sprague | 432/64 |

FOREIGN PATENT DOCUMENTS

| | | |
|---|---|---|
| DE | 2 029 494 | 12/1971 |
| DE | 31 30 297 | 2/1983 |
| DE | 43 31 496 | 4/1994 |
| DE | 299 00 646 | 6/1999 |
| EP | 0 062 845 | 10/1982 |
| GB | 2 096 296 | 10/1982 |
| GB | 2 159 615 | 12/1985 |

* cited by examiner

*Primary Examiner*—Gregory Wilson
(74) *Attorney, Agent, or Firm*—Volpe and Koenig P.C.

(57) ABSTRACT

A circulating air oven (1) is provided having nozzle chambers (27), which may be connected to either a pressurized chamber (5), or a suction chamber (39). The flow direction onto the material web (25) can be selected by opening or closing the diversion flaps (79). As each nozzle chamber (27) may be individually connected to the pressure chamber (5) or the suction chamber (49), any desired flow onto the material web can be achieved.

12 Claims, 8 Drawing Sheets

Figure 1:
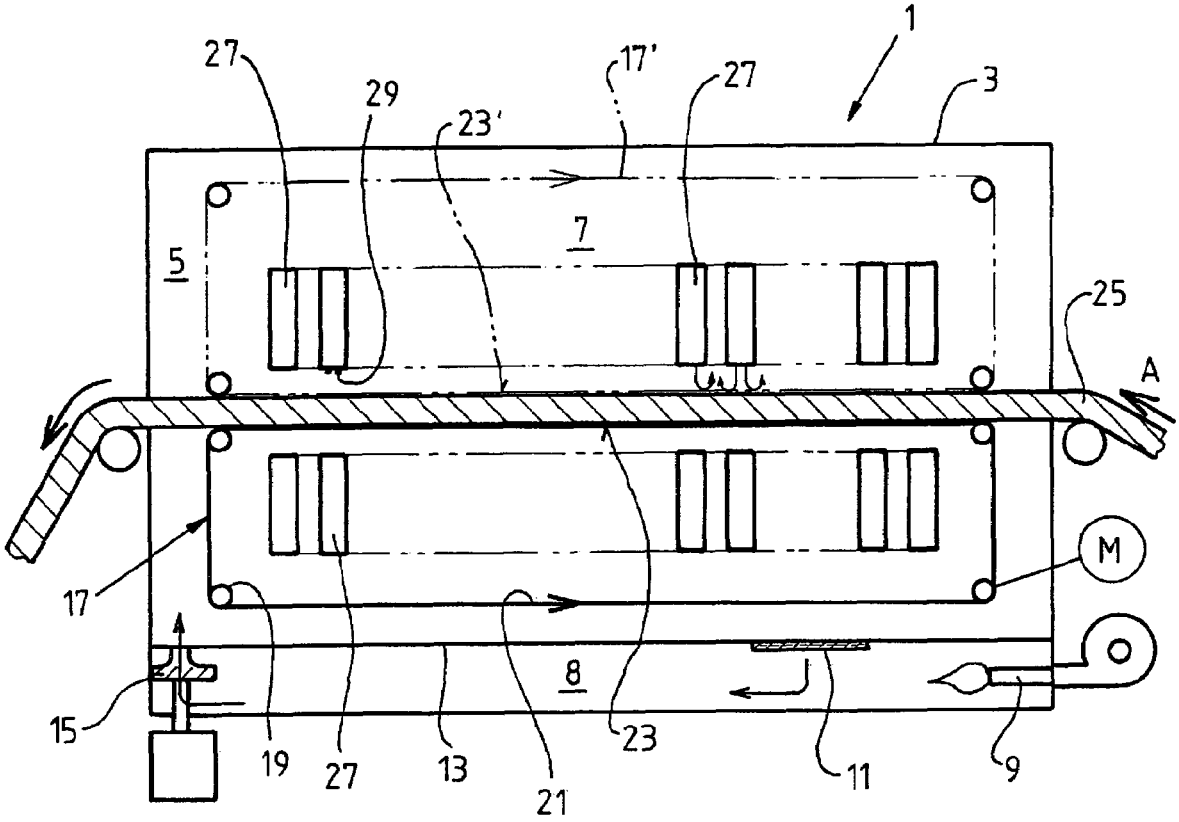

35
30
25
30
49
29
29
24

5
39
49
35
49
35
29
29
7
29

CIRCULATING AIR OVEN

FIELD OF INVENTION

The subject matter of the invention is a circulating air oven according to the preamble of claim 1.

BACKGROUND

Circulating air ovens for drying and/or fusing, in short, for treating, material webs, especially textile material webs, guided through the oven comprise a housing, in which transport means for guiding a material web through the housing are arranged. Nozzle chambers, which are arranged one next to the other and parallel to the transport direction, are attached above and below the transport means. Nozzles are attached to opposing side surfaces of these nozzle chambers facing the transport means. With the nozzles, air is blown onto the material web. The nozzle chambers are arranged in a closed discharge chamber, from which the air emerging from the nozzles is suctioned and—heated and compressed—fed back to a pressure chamber, in order to be blown again through the nozzles onto the material web.

The circulating air dryer known from EP-A1 148 113, which is built in the way described above, has the disadvantage that the air blown onto the material web is fed to the material web in a well controlled manner, but flows away from there in an uncontrollable manner, because there are not consistent relationships in terms of the surface quality, density, and thickness of the material web, and also the distance between the pressure housings.

Furthermore, from DE-A1 3130297, a device for heat treatment of a continuous web is known, in which a channel with high pressure and a channel with low pressure are allocated to each nozzle chamber. Flaps on the channels permit air to be blown with the nozzles onto the continuous web on both sides or to be suctioned from there or to be suctioned from one side and to be blown onto the other side. In addition, the nozzle chambers lie side to side, so that the blown air is suctioned through an adjacent housing or through an opposing chamber. A disadvantage for this device is that an alternating flow of air through the continuous web from bottom to top and from top to bottom is not possible.

In this respect, the invention seeks to provide a solution. Therefore, the objective of the present invention is to create a circulating air oven, which permits a controlled flow of process air to and from the material web according to essentially freely selectable criteria.

SUMMARY

This objective is met by a circulating air oven according to the features of claim 1.

In circulating air ovens according to the invention, the nozzle spaces and the nozzle chambers can be connected either to a suction chamber or to a pressure chamber, in order to guide air emerging from one nozzle through the material web in a selective way and to suction the air through the suctioning nozzles. In this way, an optimum flow of the process air through the material web can be achieved. This leads to a uniform treatment of the material web across its entire material cross section. It is especially advantageous, that the air can be distributed transverse to the material web, if the nozzle chambers alternate in a mirror-inverted arrangement. The circulating air oven according to the invention also permits the amount of air supplied to each nozzle chamber along the length of the material through the circulating air oven to be set and changed in terms of quantity. Consequently, e.g., at the beginning, it can be heated with less hot air and the amount of hot air can be increased successively or vice versa. Because it is now possible to pass the air actively through the material web, the latter acts as a filter, so that the suctioned air is much less contaminated than in conventional ovens, where the air passes over the surface of the material web and is then suctioned. For impermeable material webs, through alternating suctioning and blowing nozzles, a uniform surface treatment can be achieved. The possibility of suctioning process air with the nozzles further permits a return flow chamber to be eliminated. Now only the nozzle chambers must be insulated. This leads to a significantly better and more direct access to the treatment area in the oven. For the use of elastic bands as flaps, the settings and adjustments of the amount of air can be adapted very quickly to conditions.

When nozzle chambers with rectangular instead of wedge-shaped cross sections are used, the air guidance can be simplified to a great extent and, for example, in the transport direction of the material web, on one side, air can be guided with high pressure and, on the other side, air can be guided with low pressure. Therefore, the circulating air oven can be built in modules, in that the nozzles arranged side by side and guiding, namely, the air, are built independent of the length of the nozzle chambers arranged in-between.

BRIEF DESCRIPTION OF THE DRAWING(S)

Figure 4:
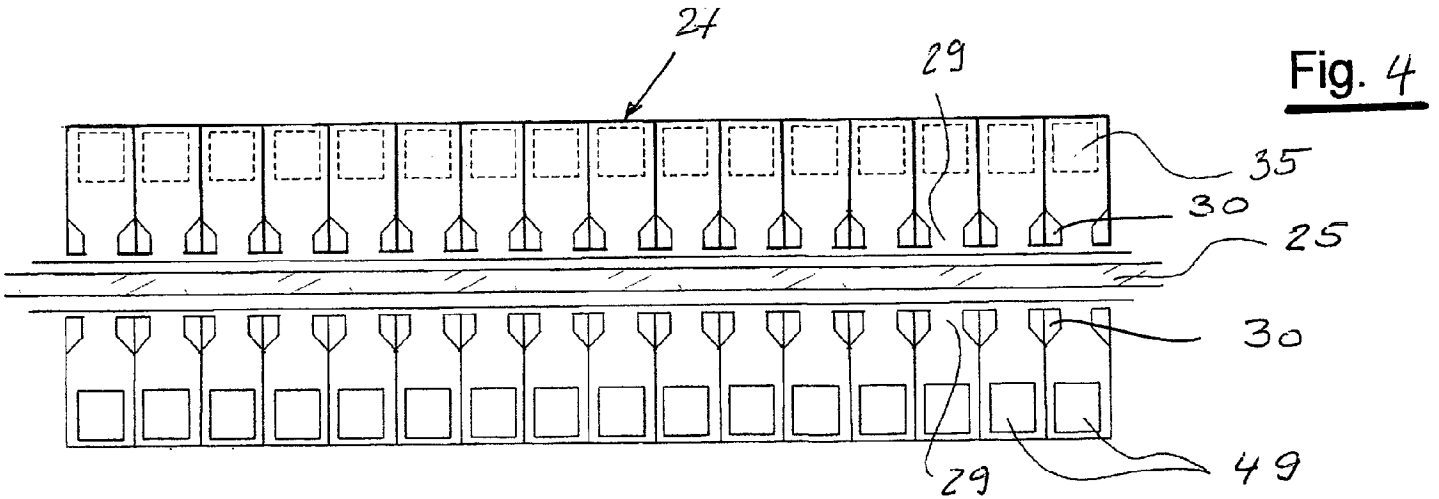
Figure 5:
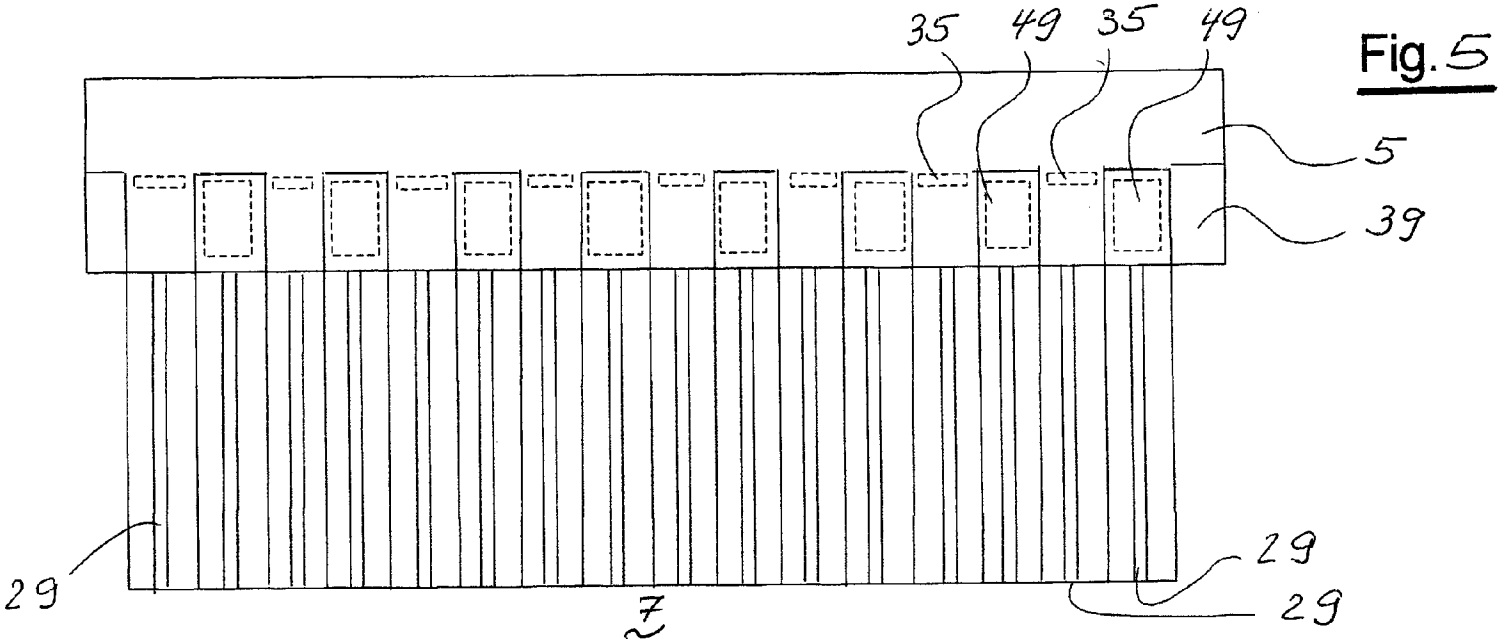

The invention will be explained in more detail with reference to an illustrated embodiment. Shown are FIG. 1 schematic view of a circulating air oven of conventional construction, FIG. 2 cross section through a conventional nozzle chamber along line II-II in FIG. 1, FIG. 3 cross section through the circulating air oven according to the invention, FIG. 4 vertical section through the two nozzle chambers according to FIG. 3, FIG. 5 plan view of the top nozzle chamber in FIG. 3, FIG. 6 schematic view of another advantageous configuration of the invention, FIG. 7 vertical section through a nozzle chamber with an elastic band as a flap, FIG. 8 perspective view of a group of nozzle chambers, on the side of the flap, and FIG. 9 vertical section through a circulating air oven with rectangular cross section (top and bottom nozzles set to "blow"), FIG. 10 vertical section through a circulating air oven with rectangular cross section (top nozzle set to "blow" and bottom nozzle set to "suction"), FIG. 11 plan view of a circulating air oven with nozzle chambers according to FIGS. 9 and 10.

DETAILED DESCRIPTION OF THE PREFERRED EMBODIMENT(S)

Figure 2:
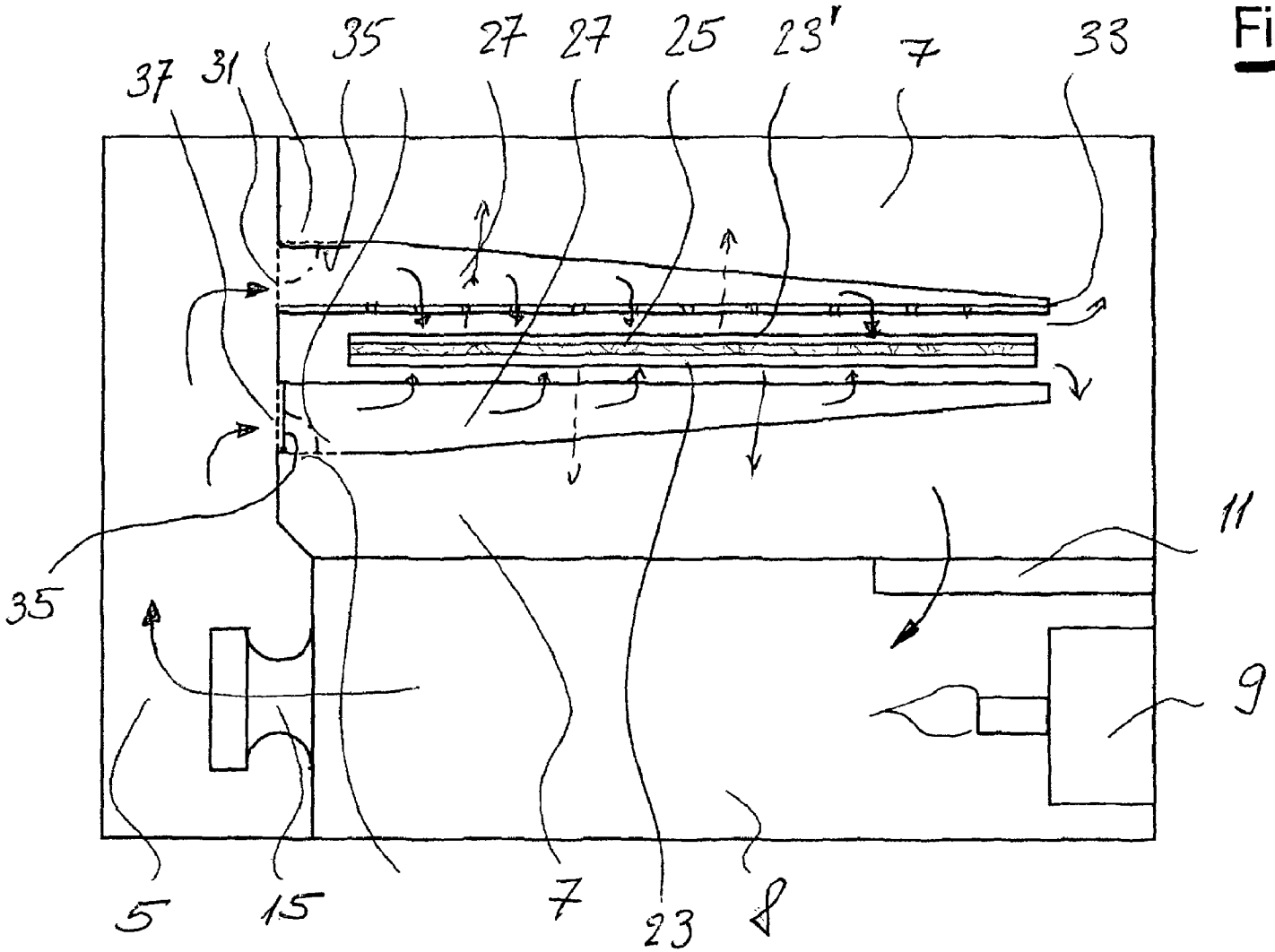

The construction of a circulating air oven 1 shown in FIG. 1 and known from EP-A1 148 113 comprises an insulated housing 3, whose interior is divided into a pressure chamber 5, a return flow chamber 7, and a heating chamber 8. The heating chamber 8, in which a heating element 9, e.g., an electric or a combustion oven, is inserted, lies between the return flow chamber 7 and the pressure chamber 5. The heating chamber 8 is connected to the return flow chamber 7 via a filter element 11. Furthermore, a blower 15, e.g., an axial-flow blower, is installed in the wall 13 between the pressure chamber 5 and the heating chamber 8.

The return flow chamber 7 comprises at least one transport means 17, preferably a conveyor belt 21 guided so that it rotates about several deflection rollers 19. The conveyor belt 21 is manufactured from an air-permeable material, such as gauze, canvas, or grating made from metal or plastic, and is driven by a motor M. In another configuration of the circulating air oven 1, a second transport means 17' can also be arranged above the first, so that two runs 23 and 23' extend parallel to each other and a material web 27 is guided in-between. The distance between these two runs 23, 23' is preferably adjustable to the thickness of the material web 25 guided in-between. The material web 25 is guided through the circulating air oven 1 by the two transport means 17 in the direction of the arrow T. Below and above the one or two transport means 17, there is a plurality of nozzle chambers 27 lying one next to the other in series. The nozzle chambers 27 extend perpendicular to the transport direction T of the material web 27 over its entire width, i.e., they extend over the width of the conveyor belt 21. Nozzles 29 for the passage of air are fixed on the bottom sides of the nozzle chambers 27, i.e., on the side surfaces facing the material web 25. The nozzle chambers 27 have a cross section that becomes narrower from the air inlet side 31 outwards. On the air inlet side 31, a pressure flap 35 is coupled, with which the opening cross section 37 to the pressure chamber 5 can be closed completely or partially (see also FIG. 2). This known arrangement enables hot air from the air inlet side 31 out to the pressure chamber 5 to be guided into the nozzle chambers 27 and from there onto the material web 25. The air impacting the material web 25 escapes in an uncontrolled manner to the side of the nozzle chambers 27 and can be led through the intermediate spaces between the adjacent nozzle chambers 27 into the return flow space 7.

The circulating air oven 1 according to the invention, as shown in FIGS. 3 to 8, comprises, in addition to the pressure chamber 5 and the return flow chamber 7, a suction chamber 39. This can extend next to the pressure chamber 5 and/or can be penetrated by the nozzle chambers 27. The suction chamber 39 is connected directly to the heating chamber 8. A passage opening 41 between the suction chamber 39 and the heating chamber 8 is spanned by a filter element. A second passage 43 between the suction chamber 39 and the return flow chamber 7 is preferably formed adjacent to the passage opening 41 from the suction chamber 39 into the heating chamber 8. The passage 43 can be completely or partially closed by a slide 45.

Figure 3:
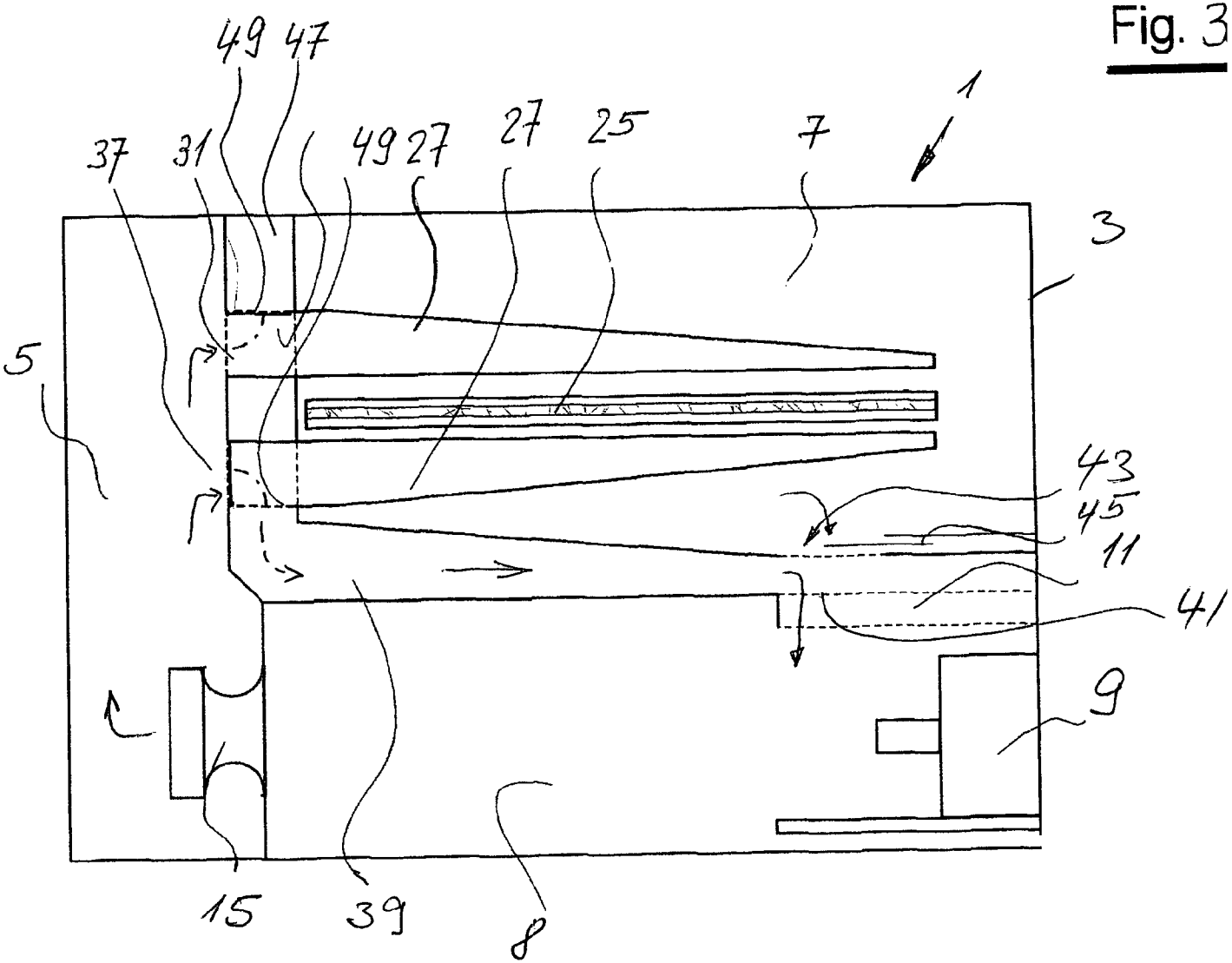

Suction flaps 49, which enable air to be suctioned with the nozzles 29, are arranged on the nozzle chambers 27 in the space 47 connecting the suction chamber 39. The air guidance in the circulating air oven according to the invention from FIG. 3 is no different from known circulating air ovens when the suction-side closing means, such as suction flaps 49, are closed and the slide 45 is open to the suction side of the blower 15. Then the air flows, namely from the nozzles 29 of the nozzle chambers 27 onto the material web 25 and from there in an uncontrolled way between the adjacent nozzle chambers 27 into the return flow chamber 7 and further through the filter 11 into the heating chamber 8.

Now, according to the invention, there is also the ability to guide and control the air actively through the material web 25, in that on one side the slide 45 is closed and thus the suction chamber 39 is connected only to the heating chamber 8, which lies on the suction side of the blower 15. Therefore a vacuum is established in the suction chamber 39. This vacuum extends through open suction flaps 49 into those suction chambers 27, in which the suction flaps 49 are open. For example, all of the bottom nozzle chambers 27 can be connected to the suction chamber 39 by opening the suction flaps 49 and the connections to the pressure chamber 5 can be closed by closing the pressure-side closing means, such as pressure flaps 35. Now the hot air flows from the top nozzle chambers 27 from the nozzles 29 through the material web 25 and is suctioned by the nozzles 29 due to the low pressure in the bottom nozzle chambers 27 or vice versa. Consequently, the hot air contacts not only the top side of the material web 25, but it is also suctioned through the material web 25 and guided into contact with all parts of the material web 25 and, as a secondary effect, the air is filtered, i.e., fibers and lint possibly separated from the surface remain in the material web 25, so that only a small number of fibers or amount of lint can reach the filter 11 through the suction chamber 39. So that no air can flow to the side and leave the flow direction directed perpendicular to the material web 25, nozzle beds 30 are formed between the nozzles 29. These beds form surfaces lying between the nozzles 29 parallel to the material web 25.

With the circulating air oven 1 according to the invention, not only can an air flow from top to bottom or from bottom to top be realized, but the suction flaps 49 can be opened and the pressure flaps 35 can be closed or vice versa alternately on the nozzle chambers 27 connected in parallel and forming a heating nozzle column, so that the flow can be realized from bottom to top or from top to bottom in an alternating or section-wise pattern.

The advance of the material web 25 through the transport means 17 creates a continuous change of the air flow direction in the material web 25. Thus, an extremely uniform flow of hot air through the material web 25 can be realized across the entire thickness of the material web 25.

Figure 6:
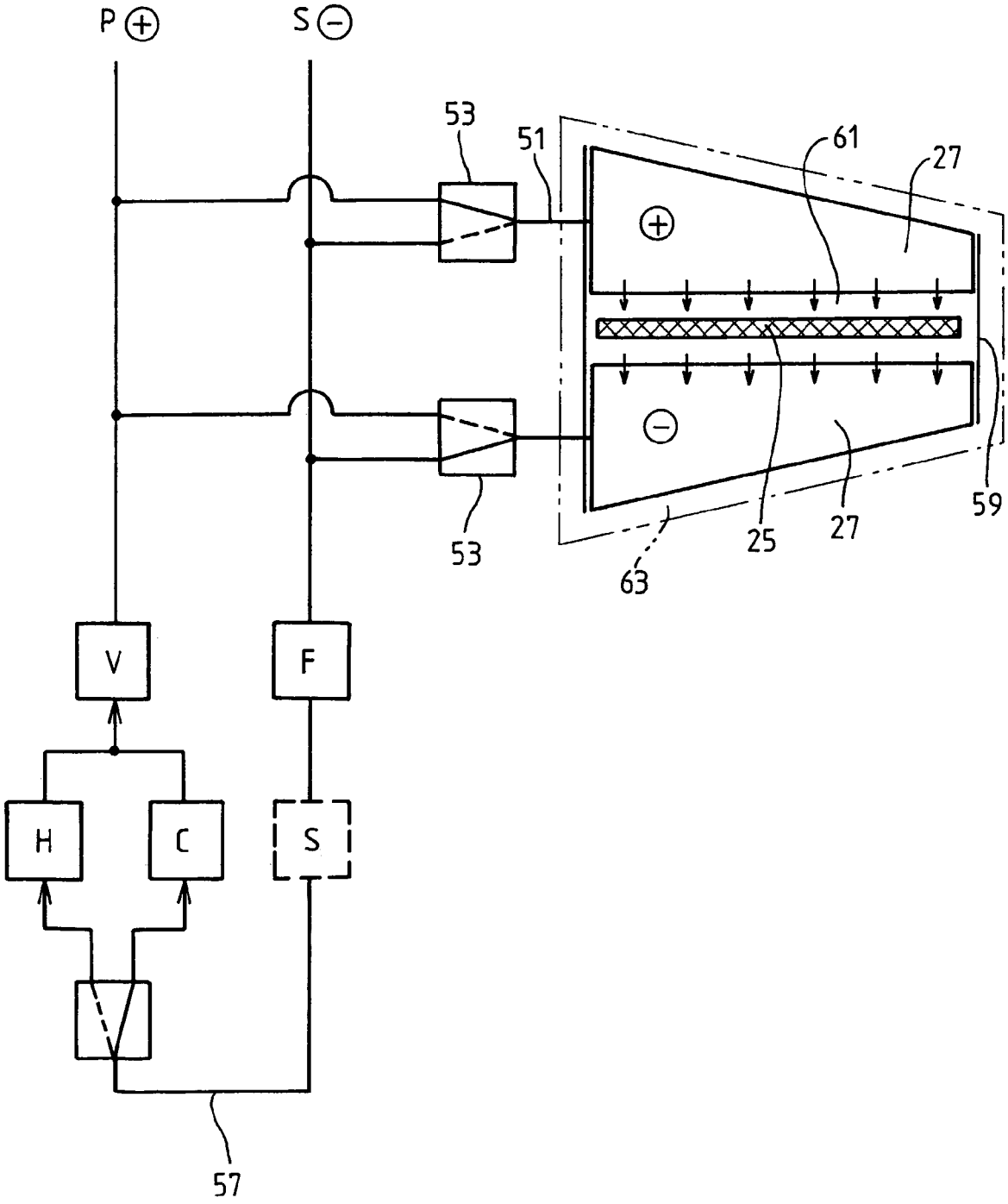

FIG. 6 shows schematically another advantageous configuration of the invention. The nozzle chambers 27 are connected through a conduit 51 to a multiple-path valve 53 or a multiple-path cap, with which a connection to a pressure conduit P or to a suction conduit S can be established selectively. The pressure conduit P is connected to a blower V, which is connected on the suction side to the suction conduit S. In the connecting conduit 57, which connects the suction conduit S to the pressure conduit P, a filter F, a suction blower S, and/or a heating system H or a cooling system C can be inserted. In the schematic view in FIG. 6, only two opposing nozzle chambers 27 are shown as representatives for a plurality of nozzle chambers 27.

In this configuration of the invention, the nozzle chambers 27 are covered by shutters 59 attached on the end, so that the processing chamber 61 between the nozzle chambers 27, through which the material web 25 is guided, is closed. Also, the intermediate space between the individual, paired, opposing nozzle chambers 27 can be closed by corresponding shutters or the nozzle chambers 27 can be arranged in a line one next to the other without mutual spacing. An insulation layer 63 prevents heat exchange with the surroundings.

In this configuration of the invention, the air flow across or through the material web can be set from pressure chamber to pressure chamber 27. The air emerging from the pressure chambers 27 at a high pressure is suctioned through the slots on pressure chambers 27 connected to the suction side. An uncontrolled air flow emerging between the pressure chambers is therefore eliminated. In contrast with the arrangement described in the introduction, this arrangement enables optimal access to the material web 25.

Furthermore, from the schematic view shown in FIG. 6, it can be seen that this arrangement enables both the supply of hot air and also of cold or, if need be, moist air. Furthermore, the returned, suctioned air can be cleaned in a filter F. To increase the vacuum, especially when a filter F is connected in front, the pressure blower V can be supported by a suction blower S. The switching of the multiple-path valve 53 can be realized manually or by using electromagnetically controllable valves by means of the machine controller. According to the configuration of the valves 53, the incoming/suctioned amount of air can also be controlled for each individual pressure chamber 27.

In another preferred configuration of the invention, the air outlet cross sections of the nozzles 29 can be set. This enables, for example, at the beginning of the heat treatment of the material web 25, a small amount of hot air to be supplied and this amount to be increased successively, whether it is now up to the end of the pass length or only over a certain area and then to reduce the amount again by decreasing the cross sections. A suitable control of the air quantity can also be achieved by an arrangement according to FIGS. 6 and 7.

Figure 7:
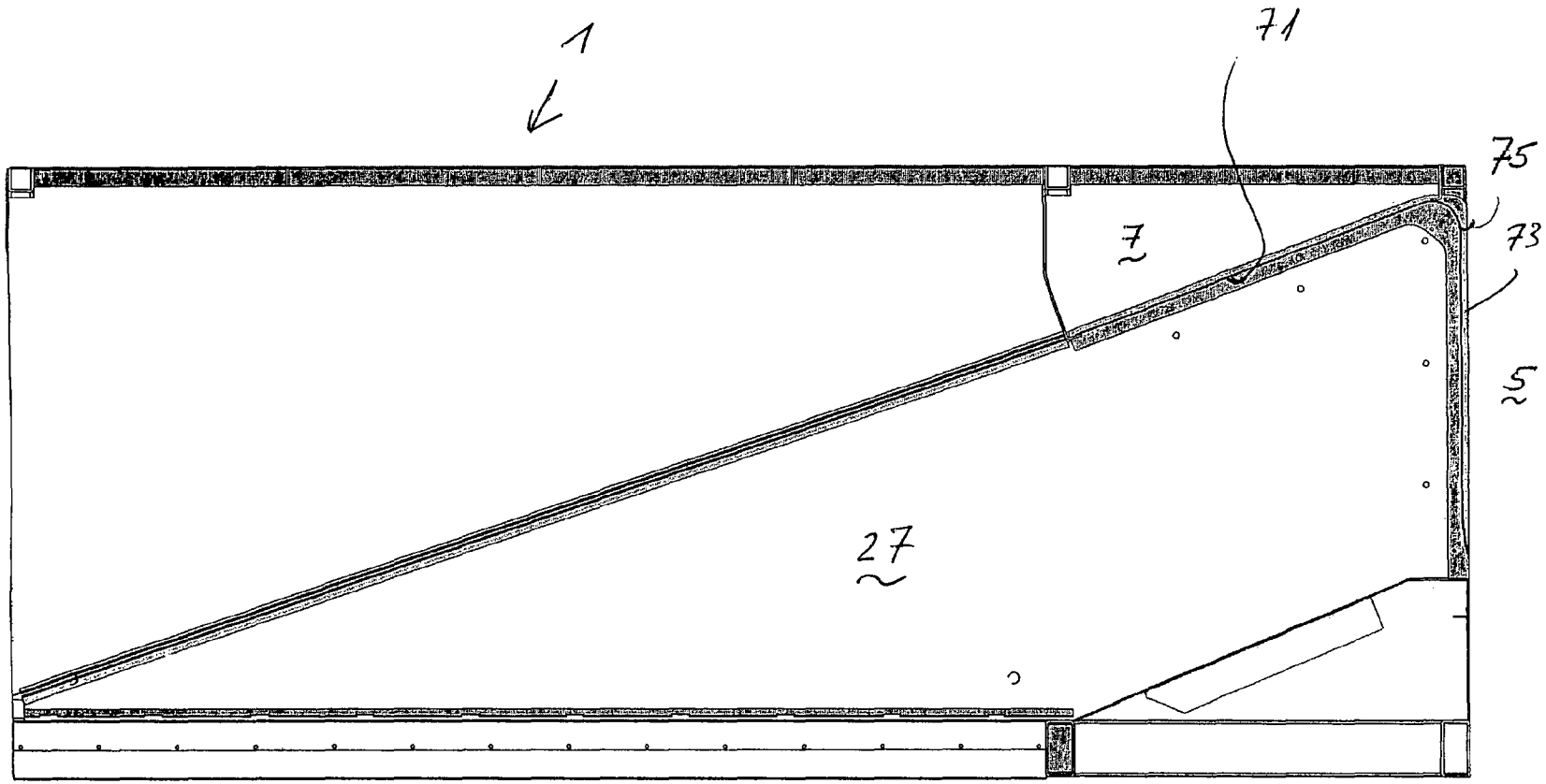
Figure 8:
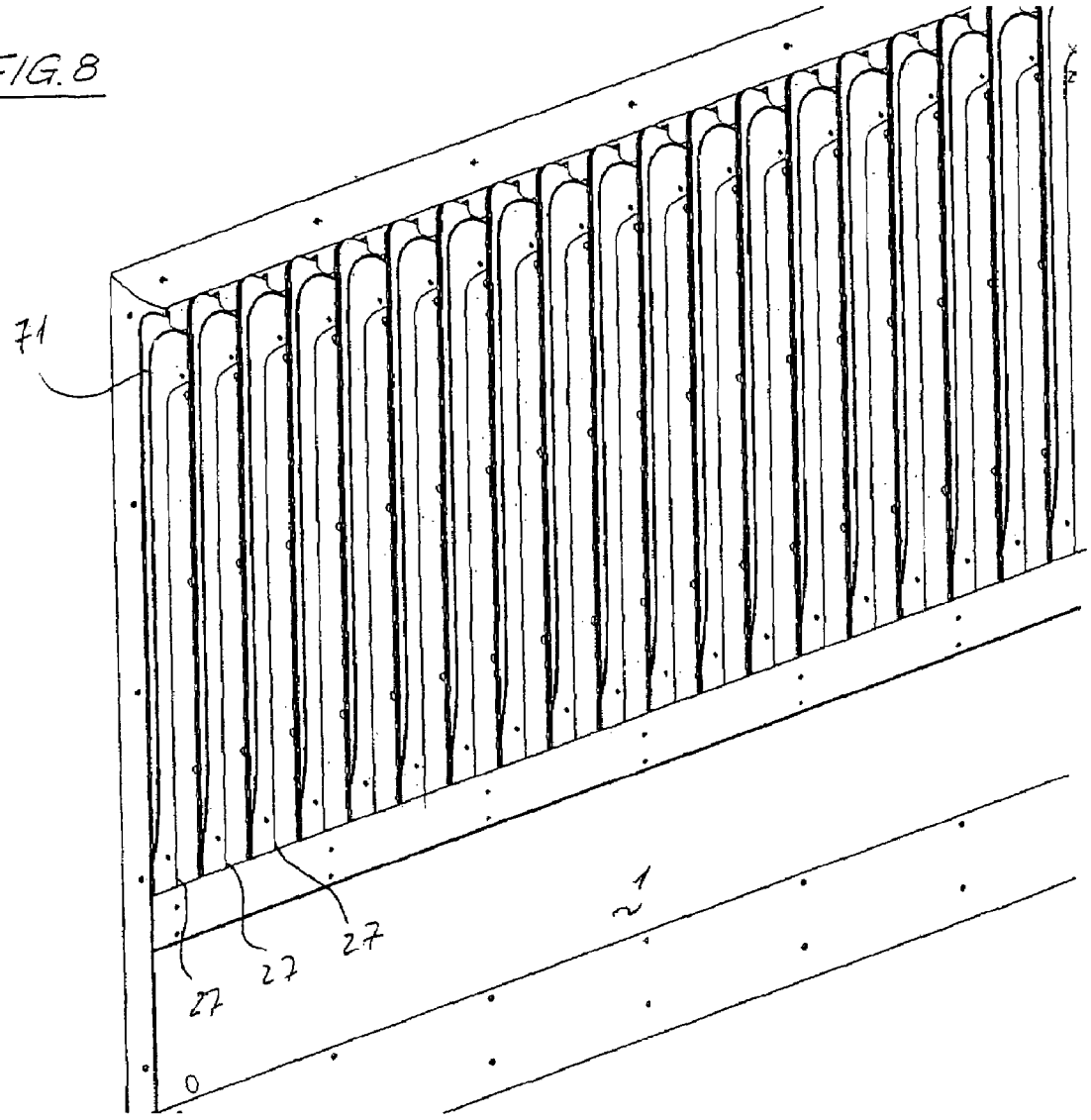

In the configuration of the invention according to FIGS. 7 and 8, an especially advantageous configuration of a closing means cap is shown. This comprises a flexible sheet-metal or plastic belt, in short, band 71, which is guided displaceably in guides 73 arranged on the side on the nozzle chambers 27. The band 71 can be moved from a closed position, in which the passage for air between the nozzle chambers 27 and the pressure (5) and the suction chambers (7) is closed, into an open position or an intermediate position, which opens the passage completely or to a desired extent. The movement of the band 71 is realized preferably by hand. For this purpose, a tab 75 is formed on one end of the band. The band 71 is held in the guides 73 in a self-locking way and therefore can be brought into any desired position and held there without additional technical means. An electromechanical movement is also possible.

Figure 9:
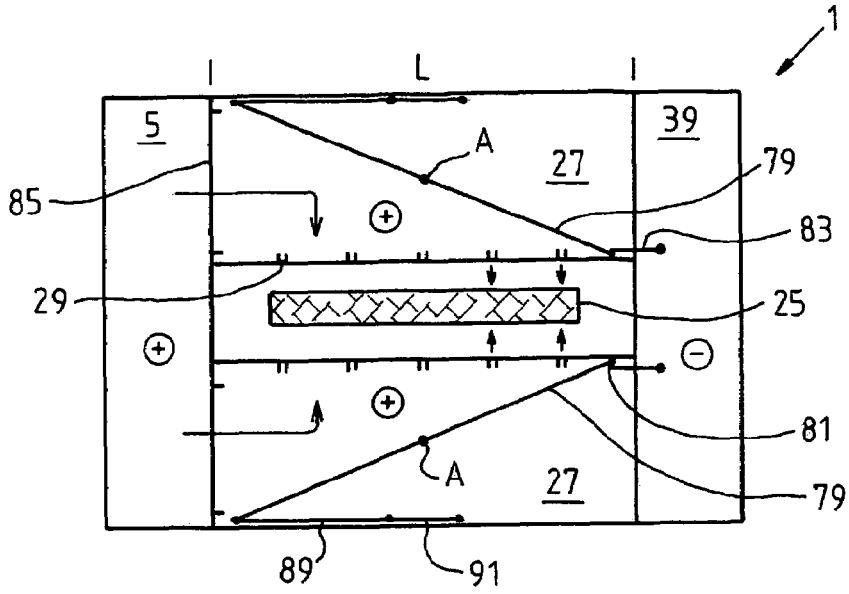
Figure 10:
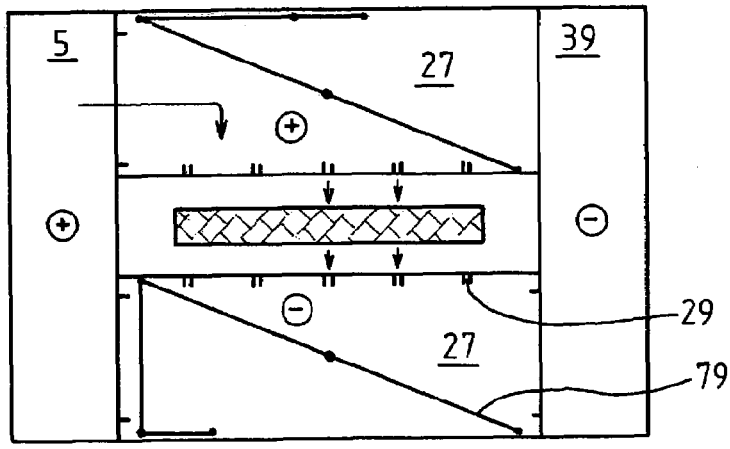
Figure 11:
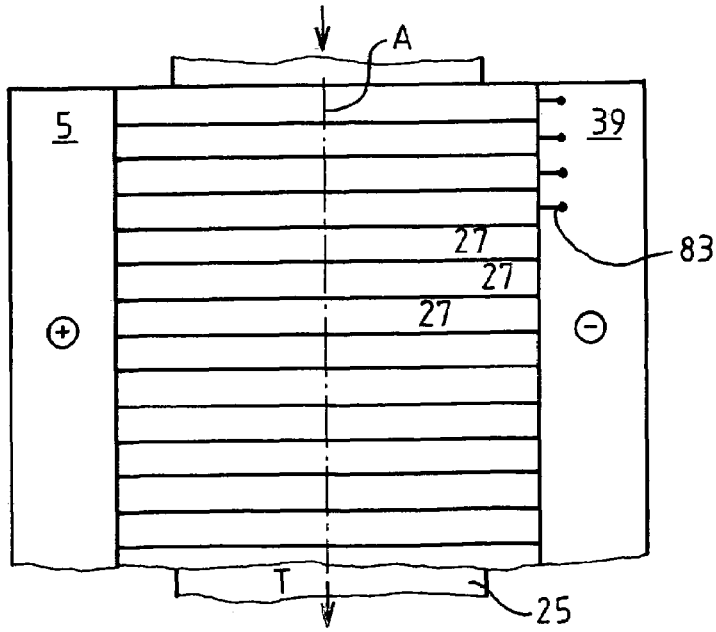

In another advantageous configuration of the invention according to FIGS. 9 to 11, the nozzle chambers 27 are cubic, i.e., they also have a rectangular shape in the vertical section. The supply of air (pressure-side opening 85) is realized from the left side outwards to a pressure chamber 5 arranged along the circulating air oven 1. The suctioning of air is realized on the right side through an opening 87 into a suction chamber 39, which also extends over the length of the circulating air oven 1. The suction chamber 39 and the pressure chamber 5 are connected to each other via a blower as in the preceding examples. This configuration of the nozzle chambers 27 creates a very balanced air distribution transverse to the material web and independent of the direction of main air flow in the nozzle chambers 27.

The embodiment of the circulating air oven 1 shown in FIGS. 9 to 11 shows the passage space 77 for the material web 25 next to the nozzle chambers 27 arranged one above the other. In the interior of the nozzle chambers 27, horizontal pivot shafts A, which are preferably supported in at least one of the side walls 27' and 27", can be seen. A diversion flap 79, which divides the interior of the nozzle chamber 27 essentially diagonally into two wedge-shaped halves, sits on each pivot shaft A. The two edges 81 of the diversion flap 79 running parallel to the shaft A contact the bottom and top side walls 27', 27" preferably at a distance to the end walls of the nozzle chambers. In other words, the diversion flap 79 runs not exactly diagonally through the nozzle chambers 27, in order to enable the flap 79 to be pivoted from one diagonal (FIG. 9, bottom) to the other diagonal (FIG. 10, bottom) without contacting the end walls. The pivoting can be realized with a handle 83 attached to the suction-side or pressure-side end of the diversion flap 79. A closing flap 89, which is guided by a guiding element 91, is preferably coupled to the pressure-side end of the diversion flap 79. When the diversion flap 79 pivots from the "pressure position" according to FIG. 9 into the suction position (FIG. 10, bottom nozzle chamber 27), the closing flap 89 is guided in front of the opening 85 in the nozzle chamber 27 and closes the latter in the "suction position." Obviously, other configurations of handles or pivot levers are also possible.

In FIG. 9, the top nozzle chamber 17 is connected to the pressure chamber 5. The diversion flap 79 contacts the nozzle chamber 17 with its one edge 81 at the top left and with the other edge at the bottom right. The diversion flap 79 permits the entry of air from the pressure chamber 5 through the opening 85 connecting to the pressure chamber 5 into the nozzle chamber 27 and from there through the nozzles 29 to the material web 25. The suction chamber 39 is connected to the top half of the nozzle chamber 27, but due to the diversion flap 79 there is no connection to the nozzles 29. By pivoting the diversion flap 79 into the position shown in FIG. 10, bottom, the suction chamber 39 is now connected to the nozzles 29. Simultaneously, the connection between the pressure chamber 5 and the nozzles 29 is broken. Consequently, air can be blown into the material web 25 from above in the arrangement according to FIG. 10 in the top nozzle chamber from the pressure chamber 5 and can be suctioned into the suction chamber 39 downwards at the bottom nozzle chambers 27.

Each of the nozzle chambers 27 can be connected individually either to the suction chamber 39 or to the pressure chamber 5.

Both the pressure chamber 5 and also the suction chamber 39 is connected to a plurality of nozzle chambers 27. According to the material web width to be processed, nozzle chambers 27 with a corresponding length L are inserted. Consequently, for nozzle chambers 27 of different lengths, identically shaped pressure chambers 5 or suction chambers 39 can be inserted, which consequently enable a modular production of the circulating air oven 1.

The circulating air oven 1 or the various freely selectable possibilities for supplying or discharging air gives the user means to adapt the profile of the heat treatment exactly to the material to be dried or to be treated.

The circulating air oven 1 according to the invention has proven to be especially advantageous when the material web 25 is compressed within the housing 3 during the heat treatment by the nozzle chambers 27 or pressure plates (not shown) arranged thereon. Through alternating supply of hot air from above and suctioning of the supplied air at the bottom or supply of hot air from below and suctioning of the hot air at the top, air can also pass uniformly through materials with a high density and thus the materials can be heat treated.

If the pressure chambers 27 arranged one next to the other are switched alternately for air passage from top to bottom or from bottom to top, then, assuming suitable nozzles 29, the material web 25 transported in the transport direction T can be set in vibration. An additional vibration or oscillation device for opening up the material web 25 can therefore be eliminated.

The invention claimed is:

1. Circulating air oven (1) for treating a material web (25) guided through the circulating air oven (1), comprising means for supplying air and means for discharging air and a blower (15) for conveying air, as well as at least one transport mechanism (17) for transport of the material web (25) through a passage space (77) between two rows of nozzle chambers (27), which guide air, which are arranged one above the other, and which extend perpendicular to a transport direction (T) of a conveyor belt (21) and having nozzles (29) arranged opposite each other, the nozzle chambers (27) are connectable to a pressure side of the blower (15) by a control means (35, 149, 53, 71, 79), the individual nozzle chambers (27) are selectively connectable to the pressure side or to a suction side of the blower (15, 55) and air can be conveyed into a pressure chamber (5) by the blower (15) and the pressure chamber (5) can be connected to each individual one of the nozzle chambers (27) by opening pressure flaps (35) or diversion flaps (79) and that a suction chamber (39) connected to the suction side of the blower (15) is arranged and can be connected by suction flaps (49) to the individual nozzle chambers (27).

2. Circulating air oven according to claim 1, wherein the pressure and the suction sides of the blower (15, 55) are connected to each other by a conduit (57) and a heating system (9, H) or a cooling system (C) and/or a filter (F) are inserted in the conduit (57).

3. Circulating air oven according to claim 2, wherein the suction chamber (39) is connected by a slide (45) with a return flow chamber (7) having a heating chamber (8).

4. Circulating air oven according to claim 1, wherein the suction and pressure flaps, as well as valves (35, 49, 53) can be activated individually, in groups, or together.

5. Circulating air oven according to claim 1, wherein cross sections of the nozzles (29) can be set and adjusted individually, in groups, or together.

6. Circulating air oven according to, claim 1, wherein a distance of opposing ones of the nozzle chambers (27) and/or pressure plates fixed thereon to the material web (25) can be set and adjusted.

7. Circulating air oven according to claim 1, wherein elastic bands (71) movable in guides (73) are formed on the nozzle chambers (27) as control flaps.

8. Circulating air oven for treating a material web (25) guided through the circulating air oven (1), comprising means for supplying air and means for discharging air and a blower (15) for conveying air, as well as at least one transport mechanism (17) for transport of the material web (25) through a passage space (77) between two rows of nozzle chambers (27), which guide air, which are arranged one above the other, and which extend perpendicular to a transport direction (T) of a conveyor belt (21) and having nozzles (29) arranged opposite each other, the nozzle chambers (27) are connectable to a pressure side of the blower (15) by a control means (35, 149, 53, 71, 79), the individual nozzle chambers (27) are selectively connectable to the pressure side or to a suction side of the blower (15, 55) and the nozzle chambers (27) have a shape of a right parallelepiped, at least partially open on end surfaces by openings (85, 87), and a diversion flap (79) dividing an interior into two wedge-shaped halves is supported in the right parallelepiped so that the flap can pivot.

9. Circulating air oven according to claim 8, wherein the diversion flap (79) can pivot about a shaft (A) running through a center from a suction position into a pressure position, and the openings (85, 87) are each respectively connected to a pressure chamber (5) and a suction chamber (39) via the end surfaces of the nozzle chambers (27).

10. Circulating air oven according to claim 8, wherein a closing flap (89) is coupled to the diversion flap (79).

11. Circulating air oven according to claim 8, wherein the pressure chamber (5) and the suction chamber (39) extend over an entire length of the nozzle chambers (27) arranged one next to the other and that a length (L) of the nozzle chambers (27) is adapted to a width of the material web (25).

12. Circulating air oven according to claim 8, wherein the pressure chamber (5) is connected to a heating element, a cooling element, and/or a dryer.

* * * * *